US007632156B1

(12) United States Patent
Chiang

(10) Patent No.: US 7,632,156 B1
(45) Date of Patent: Dec. 15, 2009

(54) CONNECTOR AND CONNECTOR ASSEMBLY HAVING TERMINALS WITH MULTIPLE CONTACT AREAS

(75) Inventor: Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,403

(22) Filed: Sep. 17, 2008

(51) Int. Cl.
*H01R 33/00* (2006.01)

(52) U.S. Cl. ..... 439/682

(58) Field of Classification Search ..... 439/284, 439/259, 682, 591
See application file for complete search history.

(56) References Cited

U.S. PATENT DOCUMENTS 5,240,430 A * 8/1993 Soes ..... 439/260
6,652,322 B2 * 11/2003 Ito et al. ..... 439/637
6,764,327 B2 * 7/2004 Yu ..... 439/188
7,488,217 B2 * 2/2009 Cheng et al. ..... 439/668
2001/0021609 A1 * 9/2001 Chiang ..... 439/682
2008/0020638 A1 * 1/2008 Polnyi ..... 439/591

* cited by examiner

*Primary Examiner*—Chandrika Prasad
(74) *Attorney, Agent, or Firm*—Rosenberg, Klein & Lee

(57) ABSTRACT

A connector assembly includes a receptacle connector having a first housing with a plurality of first terminals received therein, and a plug connector matched with the receptacle connector and having a second housing with a plurality of second terminals fixed therein. Each first terminal has a first base portion, a first contact portion, a first elastic arm, and a first propping portion formed at a free end of the first elastic arm. Each second terminal has a second base portion, a second contact portion, a second elastic arm, and a second propping portion formed at a free end of the second elastic arm. The first propping portion is against the second contact portion while the second propping portion is against the first contact portion. Therefore, the connection between the receptacle connector and the plug connector is double and more stably.

5 Claims, 6 Drawing Sheets

CONNECTOR AND CONNECTOR ASSEMBLY HAVING TERMINALS WITH MULTIPLE CONTACT AREAS

BACKGROUND OF THE INVENTION

1. Field of the Invention

The present invention relates to a connector, and more particularly to a connector assembly capable of ensuring reliable electrical connection between a receptacle connector and a plug connector thereof.

2. The Related Art

A conventional receptacle and plug connector assembly includes a receptacle connector having a first housing and a plurality of terminals received in the first housing, and a plug connector having a second housing and a plurality of contacts disposed in the second housing. When the receptacle connector is mated with the plug connector, the terminals are electrically connected with the contacts to transmit signals between the receptacle connector and the plug connector.

However, the terminal of the receptacle connector contacts one side of the contact of the plug connector to achieve electrical connection therebetween. Although the connection structure between the terminal of the receptacle connector and the contact of the plug connector is simple, the connection therebetween is unsteady, so that the terminal of the receptacle connector and the contact of the plug connector would likely be disconnected with each other when the connector assembly suffers an outside force. Therefore the connector assembly cannot transmit the signals stably and reliably.

SUMMARY OF THE INVENTION

It is an object of the present invention to provide a connector assembly capable of ensuring a stable electrical connection between a receptacle connector and a plug connector thereof.

In order to achieve the object, the receptacle connector has a first housing with a plurality of first terminals received therein. The plug connector matched with the receptacle connector has a second housing with a plurality of second terminals fixed therein. Each of the first terminals has a first base portion and a first contact portion extending from the first base portion. A first elastic arm extends from the first base portion and a first propping portion is formed at a free end of the first elastic arm. Each of the second terminals has a second base portion and a second contact portion extending from the second base portion. A second elastic arm extends from the second base portion and a second propping portion is formed at a free end of the second elastic arm. The first propping portion is against the second contact portion and the second propping portion is against the first contact portion.

As described above, because the first propping portions of the first terminals are against the second contact portions of the second terminals, while the second propping portions of the second terminals are against the first contact portions of the first terminals, the connection between the first terminals of the receptacle connector and the second terminals of the plug connector is double and more stably, which avoids the first terminals being disconnected with the second terminals when the connector assembly suffers from an outside force.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
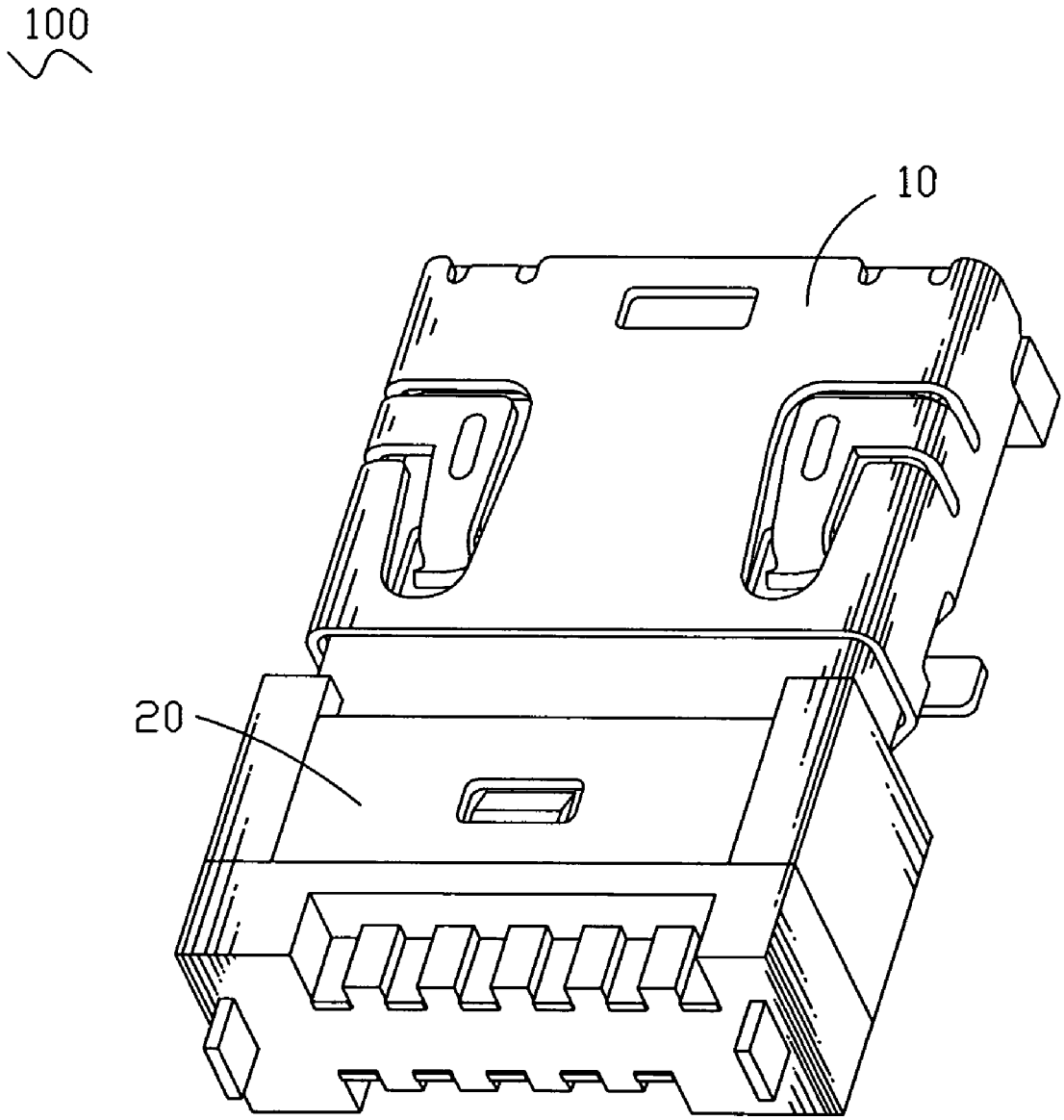
FIG. 1 is a perspective view of a connector assembly according to the present invention.

Referring to FIG. 1, a connector assembly 100 according to the present invention includes a receptacle connector 10 and a plug connector 20 mated with the receptacle connector 10.

Figure 2:
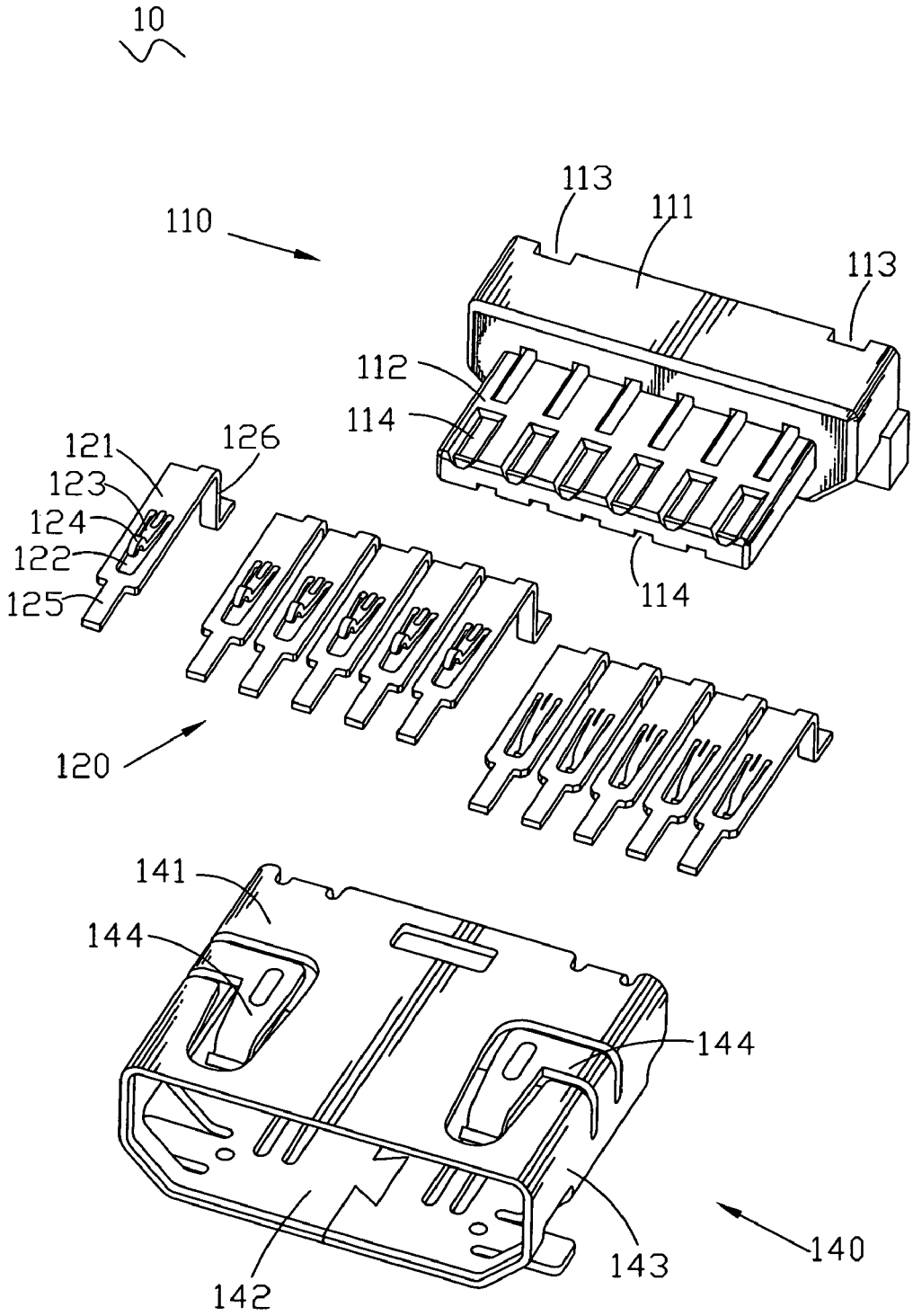
FIG. 2 is an exploded view of a receptacle connector of the connector assembly.
Figure 3:
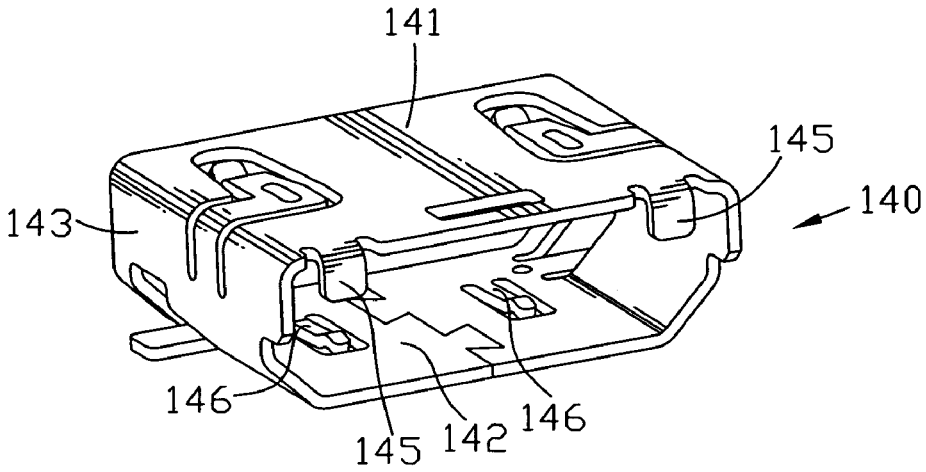
FIG. 3 is a perspective view of a shell of the receptacle connector.
Figure 4:
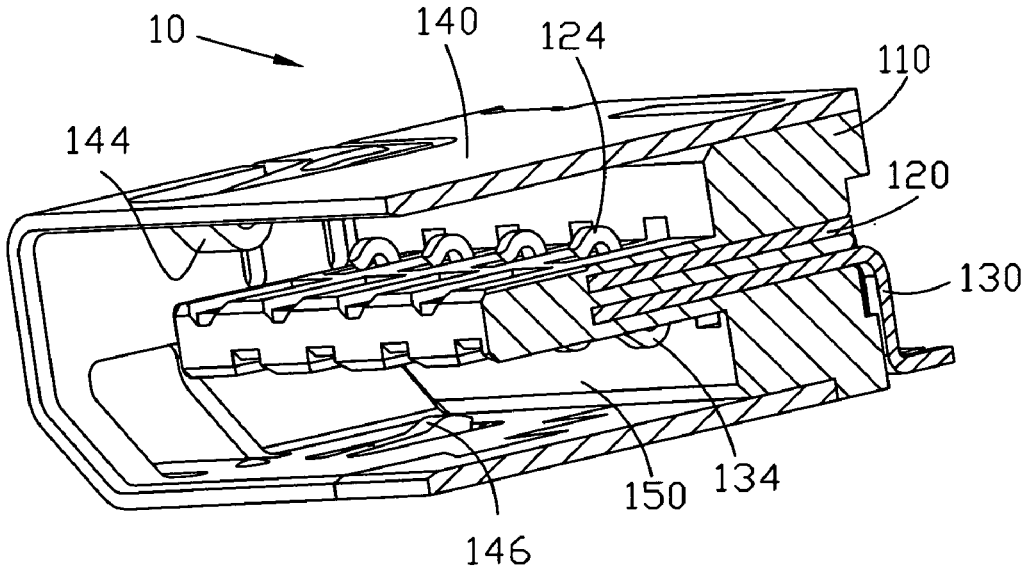
FIG. 4 is a cross-sectional view of the receptacle connector.

Referring to FIG. 2 to FIG. 4, the receptacle connector 10 includes a first housing 110, a plurality of first terminals 120 which include a first group and a second group received in the first housing 110 and a shell 140 for holding the first housing 110.

The first housing 110 has a substantially rectangular base 111 and a tongue portion 112 extending forward from a front surface of the base 111. The base 111 defines two recesses 113 at the junction of a top and rear surface thereof and adjacent to bilateral sides of the base 111. The first housing 110 defines two rows of first grooves 114 in a top and bottom portion of the tongue portion 112 and respectively extending to penetrate through the base 111.

Each of the first group of the first terminals 120 has a substantially rectangular first base portion 121, a substantially plate shaped first contact portion 125 extending forward from a front end of the first base portion 121 and a first solder portion 126 extending downward and then extending rearward from a rear end of the first base portion 121. The first base portion 121 defines a first through slot 122 and a first elastic arm 123 extending frontward into the first through slot 122 from a rear edge of the first through slot 122. A free end of the first elastic arm 123 extends upward and then extends downward to form a first propping portion 124 protruding out of the first through slot 122. The first propping portion 124 shows a substantially inverted V shape. The second group of the first terminals 120 has a similar structure to the first group, the difference is that the first propping portions 124 of the second group extend downward and then extend upward to show a substantial V shape.

The two groups of the first terminals 120 are respectively fixed in the first grooves 114 of the first housing 110, wherein the first group are positioned in the first grooves 114 defined in the top portion of the tongue portion 112, and the second group are positioned in the first grooves 114 defined in the bottom portion of the tongue portion 112. The first propping portions 124 are exposed out of the first grooves 114. The solder portions 126 extend out from the first housing 110 for being soldered to a PCB (not shown).

The shell 140 has a top wall 141, a bottom wall 142 and two sidewalls 143, all of which collectively define a receiving space 150 for holding the first housing 110 therein. The shell 140 defines two pressure pieces 144 extending inward from the sidewalls 143 to the top wall 141 and then extending frontward and inclining downward. Free ends of the pressure pieces 144 are sunken downward and protrude into the receiving space 150. The top wall 141 defines two hook pieces 145 extending towards the bottom wall 142 at a rear end thereof and respectively adjacent to the sidewalls 143. The hook pieces 145 are engaged with the recesses 113 of the first housing 110. The bottom wall 142 of the shell 140 apart defines two elastic pieces 146 projecting into the receiving space 150.

Figure 5:
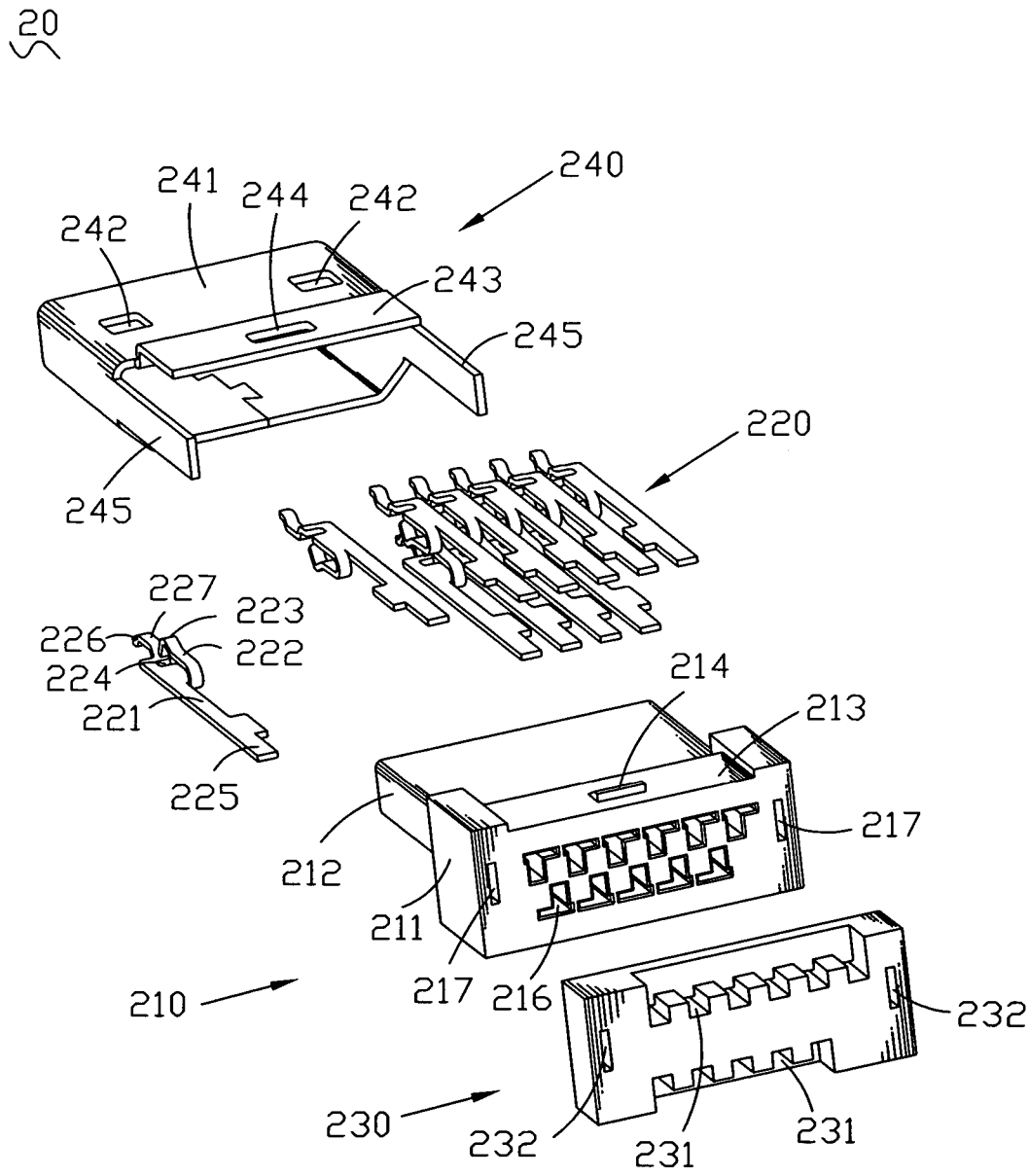
FIG. 5 is an exploded view of a plug connector of the connector assembly.
Figure 6:
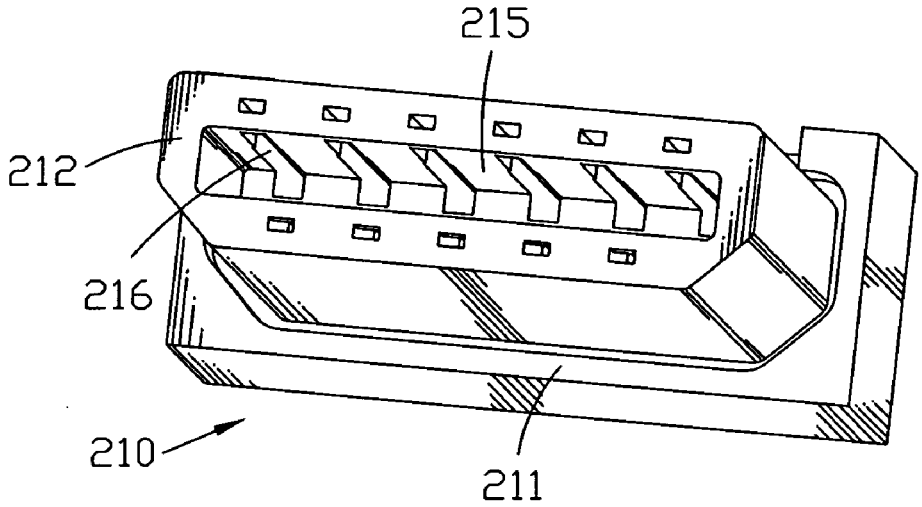
FIG. 6 is a perspective view of a second housing of the plug connector.
Figure 7:
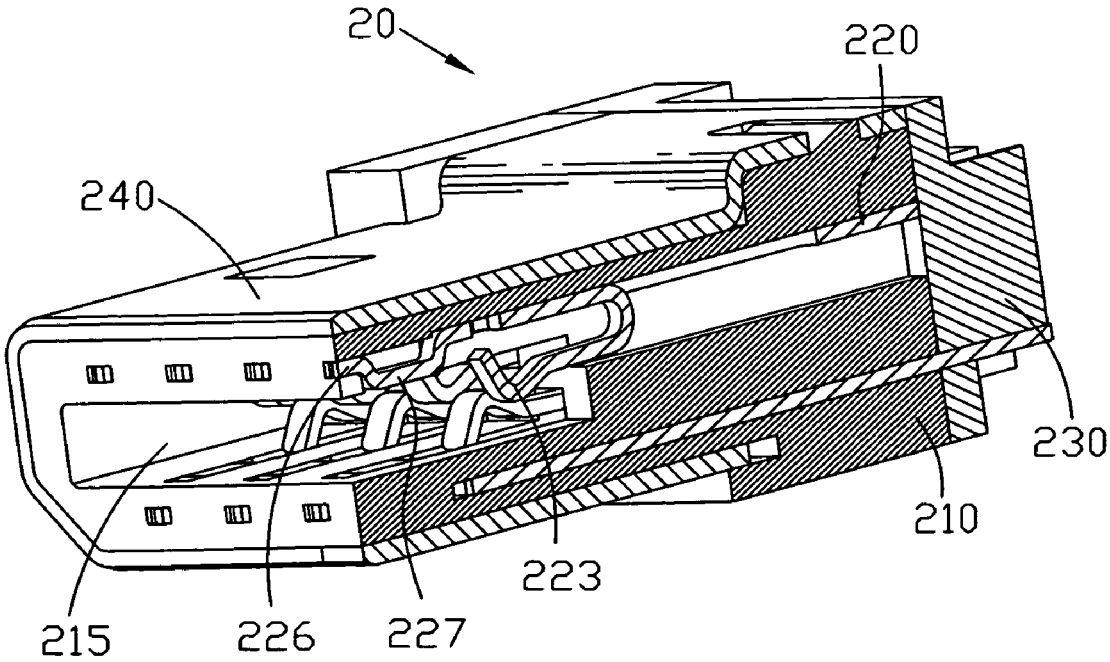
FIG. 7 is a cross-sectional view of the plug connector.
Figure 8:
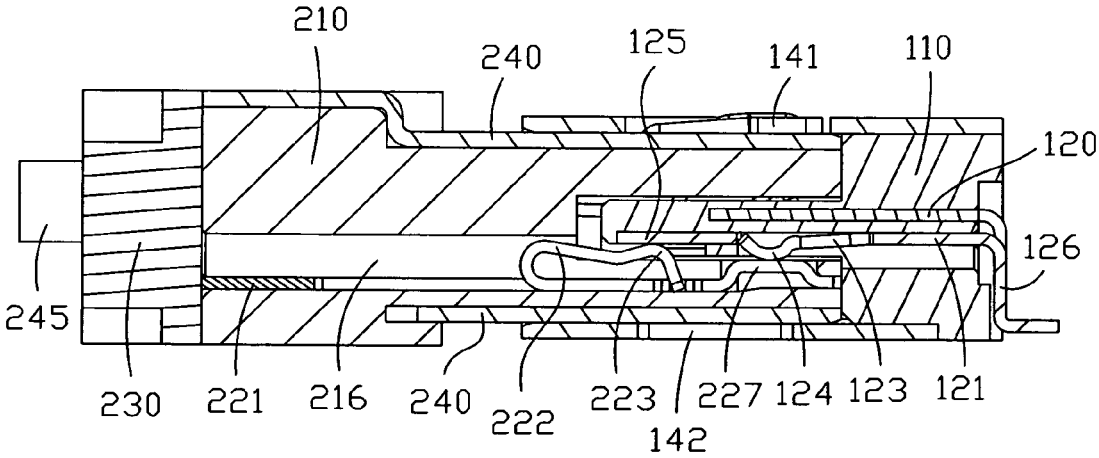
FIG. 8 is a cross-sectional view of the connector assembly shown in FIG. 1.

Referring to FIG. 5 to FIG. 7, the plug connector 20 includes a second housing 210, a plurality of second terminals 220 received in the second housing 210, a cover 230 attached to the second housing 210 and a shield 240 receiving the second housing 210.

The second housing 210 has a substantially rectangular body 211 and an extending portion 212 extending rearward from a rear surface of the body 211. A top of the body 211 defines a trough 213 passing therethrough. A wedge-shaped lump 214 projects upward at a middle portion of a bottom of the trough 213. The extending portion 212 defines a receiving cavity 215 therein. A top and bottom of the receiving cavity 215 respectively define a plurality of second grooves 216 penetrating through the extending portion 212 and the body 211. The body 211 defines two first slots 217 penetrating therethrough and adjacent to two sides thereof.

The second terminal 220 has a second base portion 221 disposed horizontally, a weld portion 225 extending forward from a front end of the second base portion 221 and a fixed portion 226 extending rearward from a rear end of the second base portion 221. A middle portion of the fixed portion 226 is arched upward to form a second contact portion 227 showing a substantial plate shape. The second base portion 221 is slit from one side thereof and then folded upward and rearward to form a second elastic arm 222. A free end of the second elastic arm 222 is arched upward to form a substantially inverted V shaped second propping portion 223. The second base portion 221 defines an opening 224 at a place corresponding to the free end of the second elastic arm 222 for avoiding the free end of the second elastic arm 222 contacting the second base portion 221 when the second elastic arm 222 is pressed.

The cover 230 is of cuboid shape and defines two rows of location channels 231 apart from each other and penetrating through an upper and lower portion thereof. The cover 230 further defines two second slots 232 penetrating therethrough and adjacent to two sides thereof.

The shield 240 has a hollow receiving portion 241 for receiving the extending portion 212 of the second housing 210. A top of the receiving portion 241 defines two fixing holes 242. A mantle layer 243 extends forward from a front end of the top of the receiving portion 241 and defines a location hole 244 at the middle portion thereof for engaging with the wedge-shaped lump 214 of the second housing 210. The receiving portion 241 has two extending arms 245 extending forward from two sides thereof.

In assembly of the plug connector 20, the cover 230 is attached to the body 211 of the second housing 210. In this case, the second grooves 216 communicate with the location channels 231 and the first slots 217 communicate with the second slots 232 correspondingly. The second terminals 220 that are divided into two groups one of which is inversely disposed beneath the other one are received in the second grooves 216. The weld portions 225 pass through the second grooves 216 and are disposed in the location channels 231. The fixed portions 226 are fixed in rear ends of the second grooves 216 and the second contact portions 227 are exposed out of the second grooves 216. The second propping portions 223 extend into the receiving cavity 215. The shield 240 receives the second housing 210. The mantle layer 243 is located in the trough 213. The wedge-shaped lump 214 is jammed into the location hole 244 for mating the shield 240 with the second housing 210 firmly. The extending arms 245 pass through the first slots 217 and the second slots 232 for locating the second housing 210 and the cover 230 together.

Referring to FIG. 1, FIG. 4, FIG. 7 and FIG. 8, when the plug connector 20 is coupled with the receptacle connector 10, the extending portion 212 of the second housing 210 is inserted into the receiving space 150 of the first housing 110. The second propping portions 223 and the second contact portions 227 of the second terminals 220 respectively electrically contact the first contact portions 125 and the first propping portions 124 of the first terminals 120. The pressure pieces 144 of the shell 140 buckle into the fixing holes 242 of the shield 240 and the elastic pieces 146 of the shell 140 support against the bottom of the shield 240 for ensuring the receptacle connector 10 to mate with the plug connector 20 tightly.

As described above, because the first propping portions 124 of the first terminals 120 are against the second contact portions 227 of the second terminals 220, while the second propping portions 223 of the second terminals 220 are against the first contact portions 125 of the first terminals 120, the connection between the first terminals 120 of the receptacle connector 10 and the second terminals 220 of the plug connector 20 is double and more stable, which avoids the first terminals 120 being disconnected with the second terminals 220 when the connector assembly 100 suffers an outside force, so that signals can be transmitted reliably between the receptacle connector 10 and the plug connector 20.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plug connector, comprising:

a housing having an extending portion with a receiving cavity formed in a front end thereof and a plurality of grooves formed in upper and lower internal sides of the extending portion in open communication with the receiving cavity and extending through the housing; and a plurality of terminals respectively fixed in the grooves, each of the terminals having a longitudinally extended plate shaped base portion, a fixed portion extending forwardly from a side of a front end of the base portion, a middle portion of the fixed portion being arched to form a plate shaped contact portion transversely spaced from the base portion, each terminal having an elastic arm formed from a slit side of the base portion that is folded forwardly to be disposed rearwardly of and substantially in longitudinal alignment with the contact portion, each terminal having, a propping portion being formed at a free end of the elastic arm, the fixed portion and the base portion being disposed in a respective groove, the contact portion being disposed adjacent to the receiving cavity and the propping portion being disposed to protrude into the receiving cavity, both the contact portion and the propping portion of each terminal being used for electrically connecting with respective portions of a mating terminal.

2. The connector as claimed in claim 1, wherein the free end of the elastic arm is arched to form the propping portion having a substantially V shaped contour, the base portion having an opening formed at a location corresponding to the free end of the elastic arm for receiving the free end of the elastic arm therein responsive to displacement of the elastic arm.

3. A connector assembly, comprising:

a receptacle connector having a first housing including a tongue portion at a front end thereof having a plurality of first grooves formed on opposing top and bottom sides thereof and a plurality of first terminals received in the first housing, each of the first terminals having a plate shaped first base portion respectively disposed in a respective one of the first grooves, each of the first terminals having a plate-shaped first contact portion extending forwardly from the first base portion, a first elastic arm extending from the first base portion, a first propping portion being formed at a free end of the first elastic arm and protruding beyond a corresponding one of the top and bottom sides of the tongue portion and being located rearwardly of and substantially in alignment with the first contact portion; and a plug connector for mating with the receptacle connector and having a second housing including an extending portion having a receiving cavity formed in a front end thereof and a plurality of second grooves formed in upper and lower internal sides of the extending portion in open communication with the receiving cavity and extending through the second housing, and a plurality of second terminals fixed in the second grooves, each of the second terminals having a longitudinally extended plate shaped second base portion, a fixed portion extending forwardly from a side of a front end of the second base portion, a middle of the fixed portion being arched to form a plate-shaped second contact portion transversely spaced from the second base portion, each second terminal having a second elastic arm formed from a slit side of the second base portion that is folded forwardly to be disposed rearwardly of and substantially in longitudinal alignment with the second contact portion, each second terminal having a second propping portion being formed at a free end of the second elastic arm, the second contact portion being disposed adjacent to the receiving cavity and the second propping portion being disposed to protrude into the receiving cavity;

wherein the tongue portion of the receptacle connector is received within the receiving cavity of the plug connector and thereby positions the first propping portion in contact with the second contact portion, and the second propping portion in contact with the first contact portion.

4. The connector assembly as claimed in claim 3, wherein the first base portion of the first terminal has a through slot formed therein, the first elastic arm being displaceable into the through slot from a rear edge of the through slot.

5. The connector assembly as claimed in claim 3, wherein the free end of the second elastic arm is arched to form the second propping portion having a substantially V shaped contour, the second base portion having an opening formed at a location corresponding to the free end of the second elastic arm for receiving the free end of the second elastic arm therein responsive to displacement of the second elastic arm.

* * * * *